US012071821B1

(12) United States Patent
Taylor et al.

(10) Patent No.: US 12,071,821 B1
(45) Date of Patent: Aug. 27, 2024

(54) LOSS PREVENTION SCREEN

(71) Applicants: Black Diamond Oilfield Rentals LLC, Houston, TX (US); Madison McLaughlin

(72) Inventors: Collin Taylor, Willis, TX (US); Christopher Biggerstaff, The Woodlands, TX (US); Charlie Kibbe, Conroe, TX (US); Jeremy Hebert, Youngsville, LA (US); Franklin McLaughlin, Tomball, TX (US); Luke Condron, Spring, TX (US)

(73) Assignee: Black Diamond Oilfield Rentals LLC, Houston, TX (US)

( * ) Notice: Subject to any disclaimer, the term of this patent is extended or adjusted under 35 U.S.C. 154(b) by 0 days.

(21) Appl. No.: 18/367,870

(22) Filed: Sep. 13, 2023

(51) Int. Cl.
*E21B 41/00* (2006.01)
*E21B 21/00* (2006.01)

(52) U.S. Cl.
CPC ..... *E21B 21/003* (2013.01)

(58) Field of Classification Search
CPC ..... E21B 27/005; E21B 21/002; E21B 43/08; E21B 43/086; E21B 43/10; E21B 21/065; B01D 29/33
See application file for complete search history.

(56) References Cited

U.S. PATENT DOCUMENTS

| | | | | | |
|---|---|---|---|---|---|
| 1,079,216 | A * | 11/1913 | Cook | E21B 43/08 | 166/236 |
| 5,611,399 | A * | 3/1997 | Richard | B01D 29/111 | 210/497.1 |
| 6,598,685 | B1 * | 7/2003 | Mashburn | E21B 27/005 | 166/227 |
| 7,549,486 | B2 * | 6/2009 | Mashburn | E21B 21/002 | 175/57 |
| 11,619,105 | B2 * | 4/2023 | Comeaux | E21B 21/08 | 166/236 |
| 2015/0267511 | A1 * | 9/2015 | Patterson | E21B 21/002 | 166/381 |
| 2018/0135371 | A1 * | 5/2018 | Cherewyk | E21B 41/0021 | |
| 2019/0264546 | A1 * | 8/2019 | O'Neal | E21B 43/10 | |
| 2020/0087996 | A1 * | 3/2020 | Romero | E21B 37/02 | |

* cited by examiner

*Primary Examiner* — Kipp C Wallace
(74) *Attorney, Agent, or Firm* — Winstead PC

(57) ABSTRACT

A loss prevention screen includes a housing and a first plurality of rods, each rod having an uphole end and a downhole end. The plurality of rods is arranged within the housing to form a flow path that forces a fluid flowing through the housing to pass through gaps formed between the plurality of rods. A loss prevention tool includes a housing having a through bore and first and second loss prevention screens positioned within the housing.

7 Claims, 7 Drawing Sheets

LOSS PREVENTION SCREEN

TECHNICAL FIELD

The present disclosure relates generally to downhole tools and more particularly, but not by way of limitation, to a downhole tool that breaks up lost circulation material (LCM).

BACKGROUND

This section provides background information to facilitate a better understanding of the various aspects of the disclosure. It should be understood that the statements in this section of this document are to be read in this light, and not as admissions of prior art.

Loss of circulation results when drilling fluid and/or cement is lost to the formation being drilled. Drilling fluid and/or cement is typically lost through cracks or fractures of the formation that intersect the wellbore. In some instances, the cracks or fractures are the result of pressure from the drilling fluid being exerted on the formation. In other instances, the cracks or fractures are naturally formed. In either case, drilling fluid or cement enters the formation through these openings, resulting in a loss of fluid to the formation. The loss of fluid is undesirable for a variety of reasons (e.g., pressure loss, loss of drilling fluid and/or cement that must be replaced costing both time and money). To alleviate the problems of loss of fluid, LCM can be added to drilling fluids to block off the openings to the formation to limit or eliminate fluid loss. While the use of LCM is effective in reducing or eliminating fluid loss, the LCM can cause other problems. For example, the LCM can aggregate into clumps that can block or damage downhole components.

SUMMARY OF THE INVENTION

This summary is provided to introduce a selection of concepts that are further described below in the Detailed Description. This summary is not intended to identify key or essential features of the claimed subject matter, nor is it to be used as an aid in limiting the scope of the claimed subject matter.

In some aspects, a loss prevention screen includes a housing and a plurality of rods. Each rod of the plurality of rods includes an uphole end and a downhole end and is arranged within the housing to form a flow path that forces a fluid flowing through the housing to pass through gaps formed between the plurality of rods.

In some aspects, the uphole end of each rod of the plurality of rods is radially farther from a central axis of the loss prevention screen than the lower end of each rod of the plurality rods.

In some aspects, the uphole end of each rod of the plurality of rods is radially closer to a central axis of the loss prevention screen than the lower end of each rod of the plurality rods.

In some aspects, each rod of the plurality of rods has a leading edge that is oriented radially outward.

In some aspects, each rod of the plurality of rods has a leading edge that is oriented radially inward.

In some aspects, each rod of the plurality of rods has a cross-section that includes at least one edge configured to help break up aggregated LCM that flows past the plurality of rods.

In some aspects, the loss prevention screen further includes a stabilizer arranged uphole relative to the plurality of rods and configured to direct a flow of fluid to an outside of the loss prevention screen before the fluid flows through the gaps formed between the plurality of rods.

In some aspects, the loss prevention screen further includes a stabilizer arranged uphole relative to the plurality of rods and configured to direct a flow of fluid to an inside of the loss prevention screen before the fluid flows through the gaps formed between the plurality of rods.

In some aspects, a loss prevention tool includes a housing having a through bore and a first loss prevention screen positioned within the housing. The first loss prevention screen includes a first stabilizer comprising a first plurality of fins; and a first plurality of rods, each rod of the first plurality of rods having an uphole end and a downhole end, the uphole end of each rod of the first plurality of rods being connected to the stabilizer. The first plurality of rods is arranged so that fluid flowing through the housing passes through gaps between adjacent rods of the first plurality of rods.

In some aspects, the loss prevention tool further includes a second loss prevention screen positioned within the housing. The second loss prevention screen includes a second stabilizer comprising a second plurality of fins; and a second plurality of rods, each rod of the second plurality of rods having an uphole end and a downhole end, one of the uphole end or the downhole end of each rod of the second plurality of rods being connected to the stabilizer. The second plurality of rods is arranged so that fluid flowing through the housing passes through gaps between adjacent rods of the second plurality of rods.

In some aspects, the first loss prevention screen is coupled to the second loss prevention screen via a stub connection.

In some aspects, the first plurality of rods contains fewer rods than the second plurality of rods.

In some aspects, each upper end of the first plurality of rods is radially closer to a central axis of the loss prevention tool than each lower end of the first plurality of rods.

In some aspects, each upper end of the second plurality of rods is radially farther from the central axis of the loss prevention tool than each lower end of the second plurality of rods.

In some aspects, a rod of the first plurality of rods has a leading edge that is oriented radially outward.

In some aspects, a rod of the first plurality of rods has a leading edge that is oriented radially inward.

In some aspects, the first stabilizer directs a flow of fluid to an outside of the first loss prevention screen before the fluid flows between the first plurality of rods.

In some aspects, the first stabilizer directs a flow of fluid to an inside of the first loss prevention screen before the fluid flows between the first plurality of rods.

In some aspects, the first loss prevention screen is coupled to the second loss prevention screen via a link; and the loss prevention tool is configured so that fluid flowing through the loss prevention tool flows through first stabilizer and then into an interior of the first loss prevention screen, and then through the second stabilizer before flowing into an interior of the second loss prevention screen.

In some aspects, the first plurality of rods contains fewer rods than the second plurality of rods.

BRIEF DESCRIPTION OF THE DRAWINGS

A more complete understanding of the subject matter of the present disclosure may be obtained by reference to the following Detailed Description when taken in conjunction with the accompanying Drawings wherein.

DETAILED DESCRIPTION

It is to be understood that the following disclosure provides many different embodiments, or examples, for implementing different features of various embodiments. Specific examples of components and arrangements are described below to simplify the disclosure. These are, of course, merely examples and are not intended to be limiting. The section headings used herein are for organizational purposes and are not to be construed as limiting the subject matter described. Reference will now be made to more specific embodiments of the present disclosure and data that provides support for such embodiments. However, it should be noted that the disclosure below is for illustrative purposes only and is not intended to limit the scope of the claimed subject matter in any way.

During drilling operations, a problem can arise where downhole fluids are lost to the rock formation being drilled. The loss of fluids complicates the drilling process, costing both time and money to address. One method of limiting or eliminating the loss of fluids is to use lost circulation material ("LCM"). LCM is available in various forms, including a granular type, a fibrous type, and a flaky type. Granular type LCM is made from a variety of materials, typically natural waste products like corn cobs, wood, finely ground marble or limestone, and the like. Flaky type LCM is made from a variety of materials, including plastic flakes, mica flakes, and the like. Fibrous type LCM is typically made from mineral fibers, tree barks, shredded corn stalk, and the like.

During drilling, the LCM is added to the drilling fluid that is pumped downhole. If the LCM encounters any openings (e.g., cracks or fractures) in the rock formation, the flow of fluid into those openings caries with it the LCM. The LCM begins to aggregate at these flow points and forms a plug that limits or eliminates the flow of fluid therethrough. In this manner, LCM serves a valuable function in that fluids do not escape the wellbore and flow into the surrounding rock formation. However, LCM that does not lodge itself in an opening continues to flow downhole. In some instances, larger pieces or clumps of aggregated LCM can create problems. For instance, the LCM can damage or clog components of the drill string (e.g., components of the bottom hole assembly etc.). In order to reduce the risk of damaging components of the drill string, a loss prevention tool can be used to break up aggregated LCM.

Figure 1:
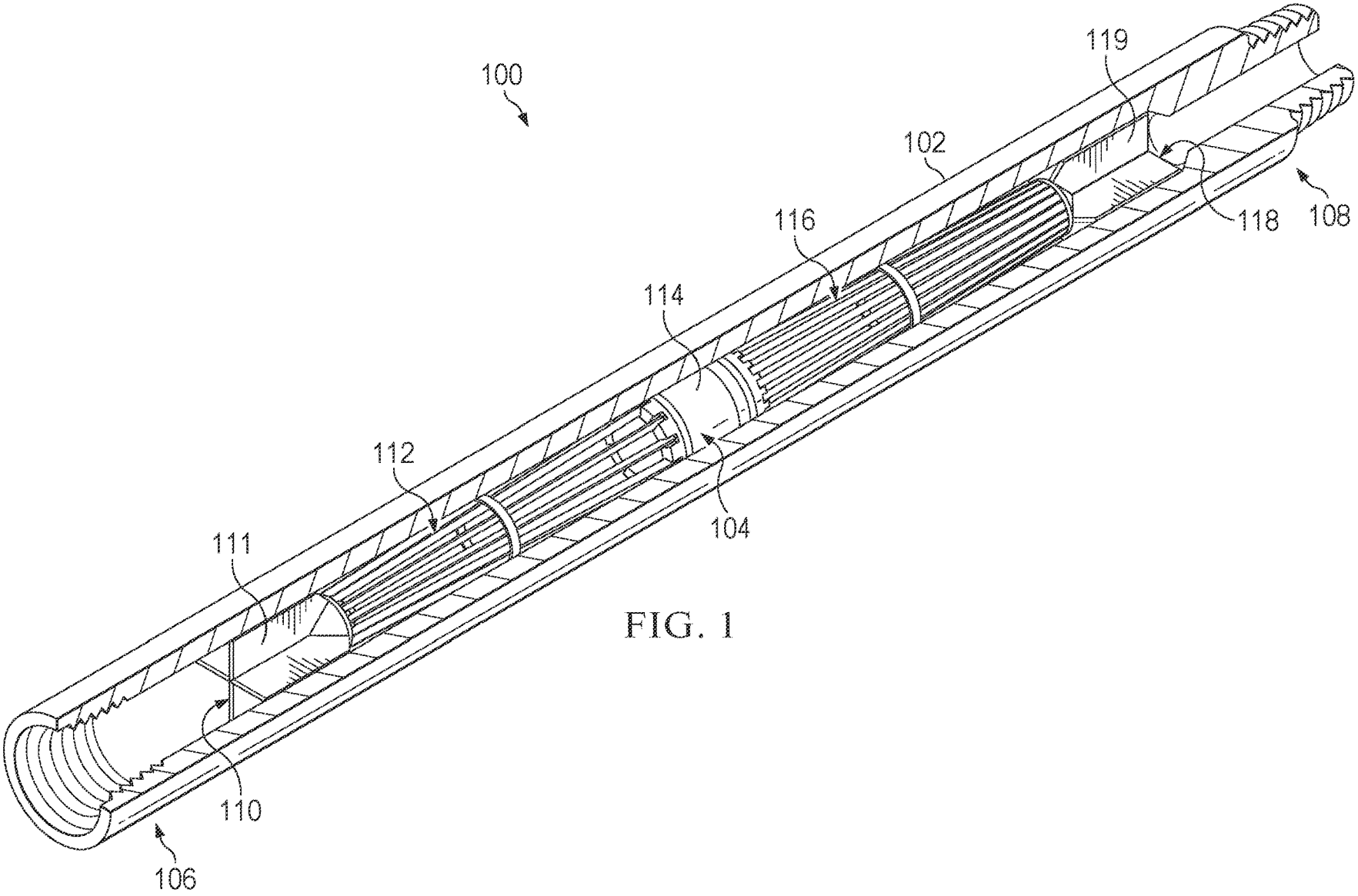
FIG. 1 is a sectioned perspective view of a loss prevention tool according to aspects of the disclosure.
Figure 2:
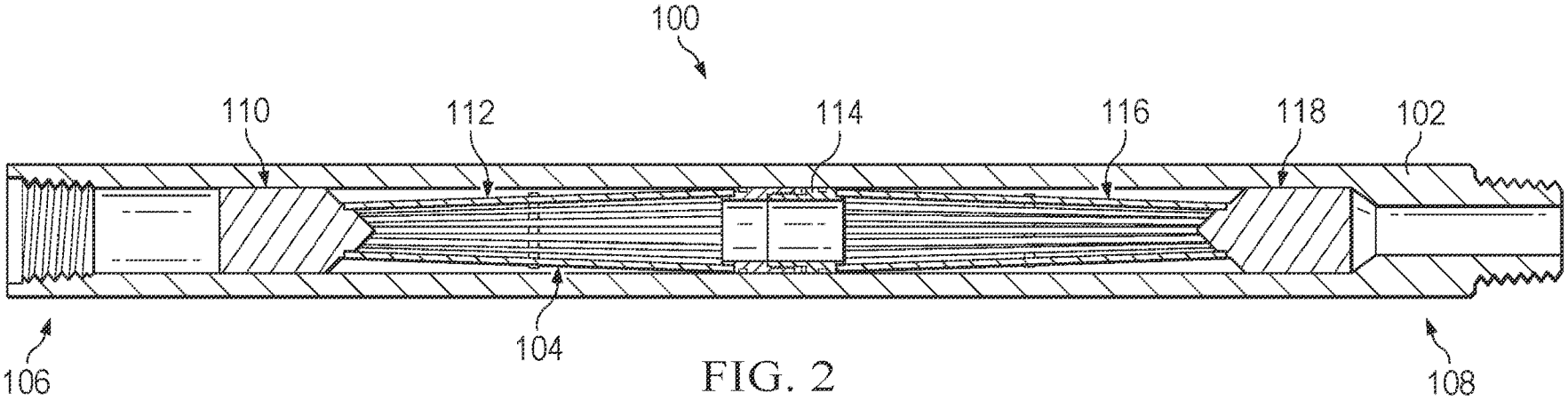
FIG. 2 is a sectioned side view of the loss prevention tool of FIG. 1 according to aspects of the disclosure.
Figure 3:
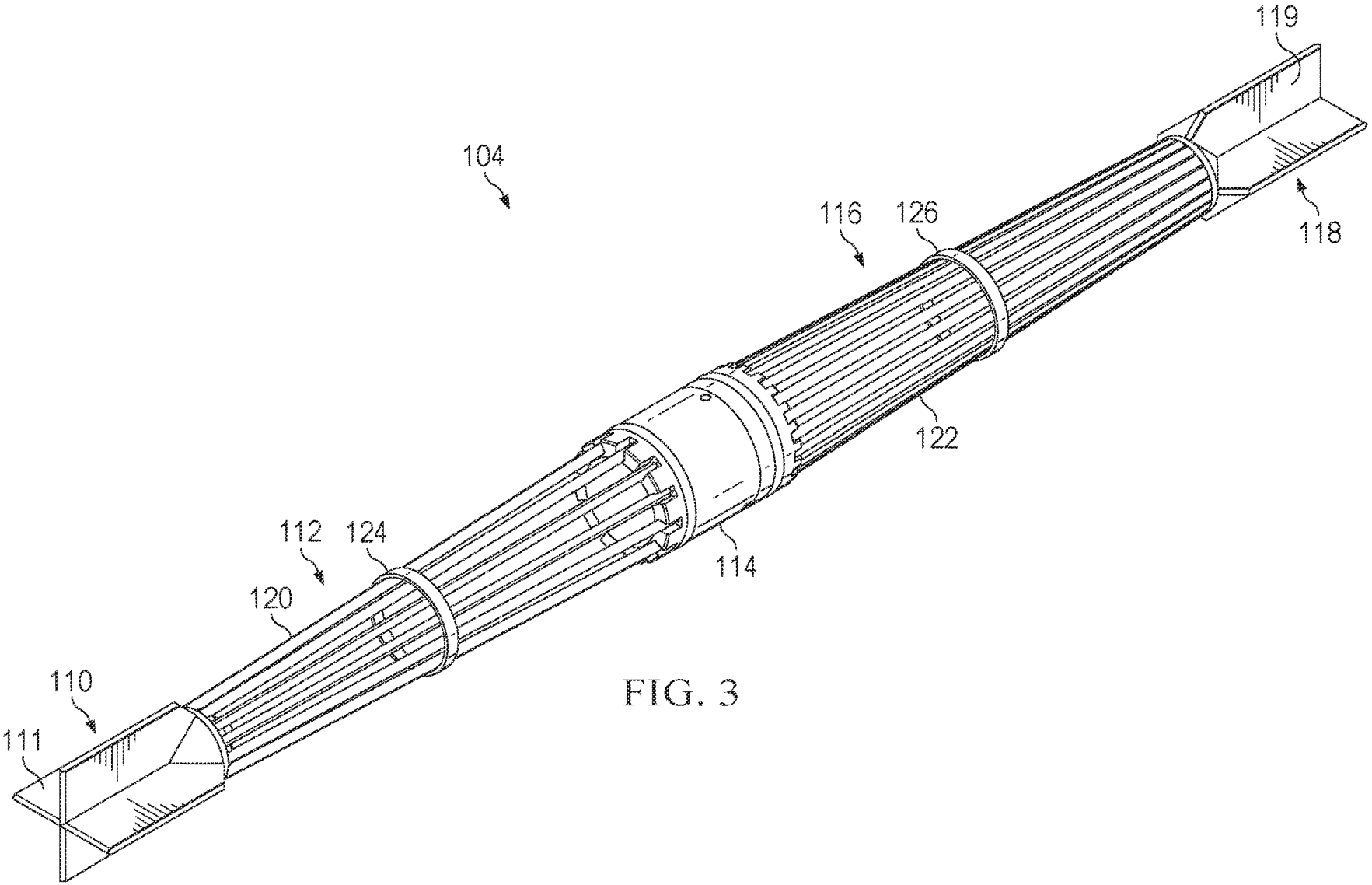
FIG. 3 is perspective view of a loss prevention screen according to aspects of the disclosure.
Figure 4:
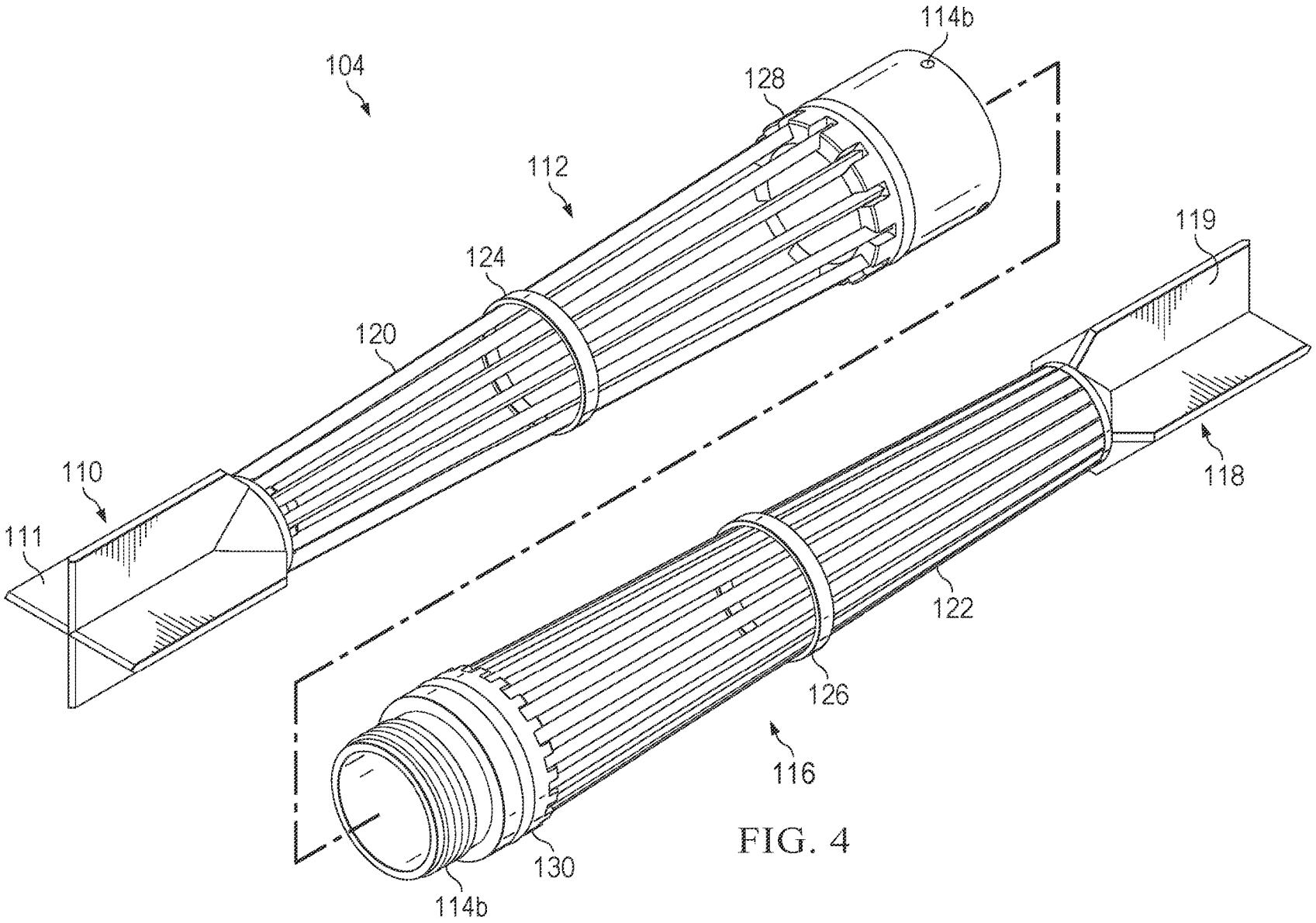
FIG. 4 is an assembly of the loss prevention screen of FIG. 3 according to aspects of the disclosure.

FIGS. 1-4 illustrate a loss prevention tool 100 according to aspects of the disclosure. FIG. 1 is a sectioned perspective view of the loss prevention tool according to aspects of the disclosure; FIG. 2 is a sectioned side view of the loss prevention tool according to aspects of the disclosure; FIG. 3 is perspective view of a loss prevention screen according to aspects of the disclosure; and FIG. 4 is an assembly of the loss prevention screen of FIG. 3 according to aspects of the disclosure.

Referring to FIGS. 1-4 collectively, tool 100 can be placed in line with a drill string. In various aspects, tool 100 may be positioned at different points along the drill string. For example, tool 100 may be positioned above or between the measurement while drilling/bottom hole assembly. In some aspects, tool 100 may be positioned close to the surface to make removing of tool 100 easier for cleaning etc. Tool 100 includes a housing 102 with bore in which a loss prevention screen 104 is situated. Housing 102 has an uphole end 106 and a downhole end 108. The bore of housing 102 includes a tapered portion near downhole end 108 that helps retain screen 104 within housing 102 as downhole end 108 has an internal diameter that is smaller than the outside diameter of loss prevention screen 104. As illustrated in FIG. 1, tool 100 is configured to threadably attach to the drill string, with uphole end 106 being configured with female threads and downhole end 108 being configured with male threads. In other aspects, tool 100 could be secured to the drill string via other connections.

Loss prevention screen 104 includes an uphole stabilizer 110 and a downhole stabilizer 118 that are configured to radially locate screen 104 within housing 102, stabilizing loss prevention screen 104 from excessive movement within housing 102. Stabilizers 110, 118 include a plurality of fins 111, 119, respectively (illustrated as four fins in FIGS. 1-4, but the number of fins could be increased or decreased). Fins 111, 119 extend to an inner wall of housing 102 to limit movement of loss prevention screen 104 within housing 102 and further provide some assistance with breaking up aggregated LCM (e.g., as LCM flows around the fins, some aggregated LCM impacts an edge of the fins and is broken up into smaller pieces). In some aspects, one or both of stabilizers 110, 118 can be omitted and screen 104 may be radially located within housing 102 by threaded connection 114 or by other features of screen 104 (e.g., lips, fasteners, etc.).

Loss prevention screen 104 includes an uphole screen 112 and a downhole screen 116. In some aspects, screens 112, 116 are joined together via a threaded connection 114 that threads together. In other aspects, screens 112, 116 may be joined together by various other types of connections or could be unitary. Screen 112 comprises a plurality of rods 120 that extend from stabilizer 110 to threaded connection 114. An uphole end of each rod 120 is secured to stabilizer 110 and a downhole end of each rod 120 is secured to threaded connection 114. The plurality of rods 120 are arranged so that the uphole ends of each rod 120 are radially closer to a central axis of tool 100 (farther from the inner wall of housing 102) than the downhole ends of each rod 120 (i.e., in a frustoconical shape). This arrangement forces fluids flowing through screen 112 to flow from outside screen 112 to inside screen 112 (note: threaded connection 114 extends to the inner wall of housing 102, forcing fluid to flow through the plurality of rods 120 and into screen 112). As the fluid containing LCM flows past rods 120, aggregated LCM impacts rods 120 and is broken into smaller pieces. In some aspects, a ring 124 is secured to rods 120 to provide rigidity and structure to rods 120. Fluid flows through screen 112 and through a bore of threaded connection 114 before entering an inside of screen 116.

Screen 116 comprises a plurality of rods 122 that extend from threaded connection 114 to stabilizer 118. An uphole end of each rod 122 is secured to threaded connection 114 and a downhole end of each rod 122 is secured to stabilizer 118. The plurality of rods 122 are arranged so that the uphole ends of each rod 122 are spaced radially farther from the central axis of tool 100 (closer to the inner wall of housing 102) than the downhole ends of each rod 122 (i.e., in a frustoconical shape). This arrangement forces fluids flowing through screen 116 to flow from inside screen 116 to outside screen 116. Fluid flows through screen 116 and past stabilizer 118 before exiting tool 100. In some aspects, a ring 126 is secured to rods 122 to provide rigidity and structure to rods 122. As the fluid containing LCM flows through screen 116 and past stabilizer 118, aggregated LCM in the fluid is further broken down into smaller pieces.

In some aspects, tool 100 includes fewer rods 120 than rods 122 in order to decrease the effective screening size as fluid flows through tool 100. This is done to gradually break down aggregated LCM into smaller pieces with each pass through screens 112, 116. In some aspects, tool 100 includes the same number of rods 120 as rods 122. In some aspects, tool 100 includes more rods 120 than rods 122. As shown in FIGS. 1-4, the lengths of rods 120, 122 are shown to be equal. In other aspects, the lengths of rods 120 may be longer or shorter than the length of rods 122.

In some aspects, rods 120 are designed with a shaped profile so that a leading edge of each rod 120 is arranged to impact incoming aggregated LCM improve the rods' ability to break up the aggregated LCM. "Leading edge" is used to describe a meeting of two faces (e.g., FIG. 5(*a*) has four leading edges, FIG. 5(*b*) has three leading edges, etc.) or a rounded profile between two faces (e.g., FIG. 5(*f*) has one rounded profile between two faces, etc.) of a cross-section of a rod. A leading edge of each rod 120 is arranged radially outward, opposite the direction of fluid flow. Rods 122 may similarly include a leading edge, however a leading edge for rods 122 is arranged radially inward, opposite the direction of fluid flow.

Figure 5:
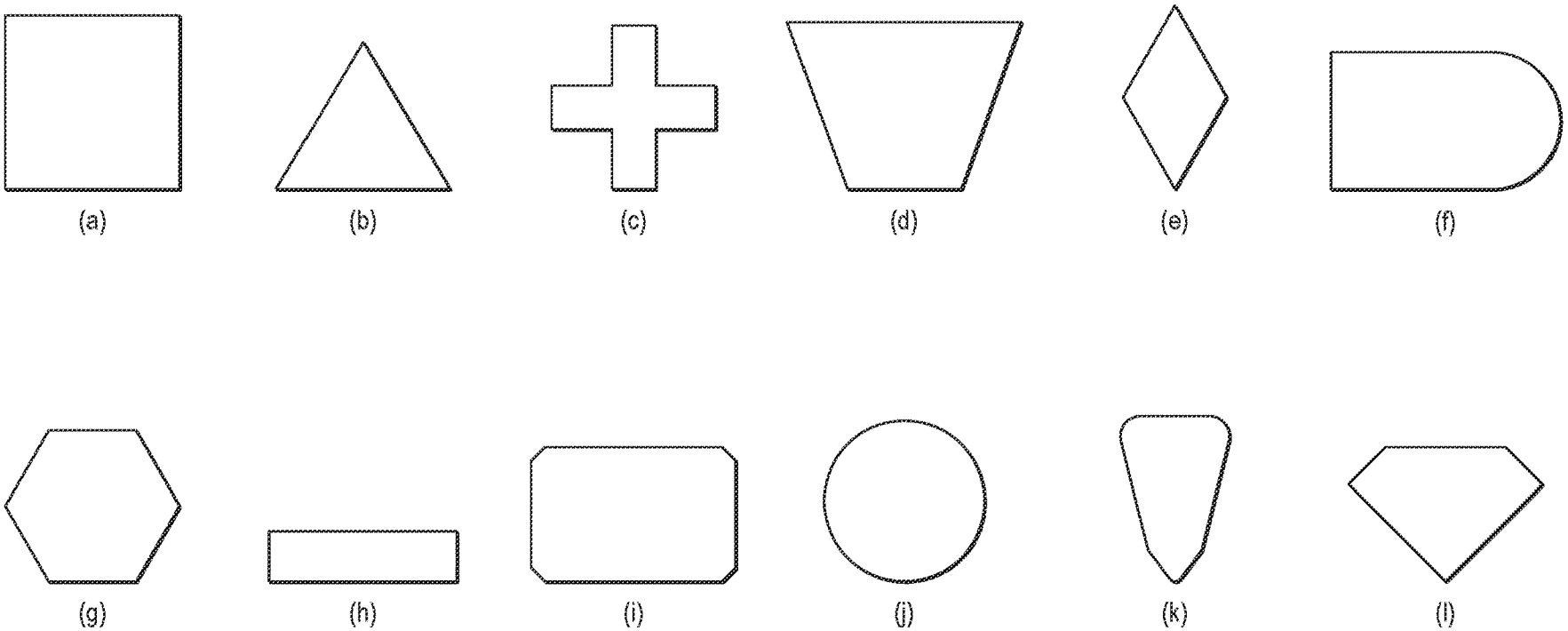
FIGS. 5(*a*)-5(*l*) illustrate different cross-sections for rods of a loss prevention screen according to aspects of the disclosure.

FIGS. 5(*a*)-5(*l*) illustrate different cross-sections for rods of a loss prevention screen according to aspects of the disclosure. FIG. 5(*a*) illustrates a square cross-section. This cross-section may be oriented with any of the four edges oriented opposite the direction of fluid flow. In some aspects, the square cross-section can be oriented so that one of the faces is oriented perpendicular to the flow of fluid.

FIG. 5(*b*) illustrates a triangular cross-section. This cross-section may be oriented with any of the three edges oriented opposite the direction of fluid flow. In some aspects, the triangular cross-section can be oriented so that one of the faces is oriented perpendicular to the flow of fluid.

FIG. 5(*c*) illustrations a cross cross-section. This cross-section may be oriented with any of the four points of the cross oriented opposite the direction of fluid flow. In some aspects, the cross cross-section can be oriented so that none of the four points are oriented opposite the direction of the flow of fluid.

FIG. 5(*d*) illustrates a trapezoidal cross-section. This cross-section may be oriented with any of the four edges oriented opposite the direction of fluid flow. In some aspects, the trapezoidal cross-section can be oriented so that any one of the faces is oriented perpendicular to the flow of fluid.

FIG. 5(*e*) illustrates a diamond cross-section. This cross-section may be oriented with any of the four edges oriented opposite the direction of fluid flow. In some aspects, the diamond cross-section can be oriented so that any one of the faces is oriented perpendicular to the flow of fluid.

FIG. 5(*f*) illustrates a bullet-shaped cross-section. This cross-section may be oriented with the rounded face or the flat face opposite the rounded face opposite the direction of fluid flow. In some aspects, the bullet-shaped cross-section can be oriented so that either one of the side faces is oriented perpendicular to the flow of fluid.

FIG. 5(*g*) illustrates a hexagonal cross-section. This cross-section may be oriented with any of the six edges oriented opposite the direction of fluid flow. In some aspects, the hexagonal cross-section can be oriented so that one of the faces is oriented perpendicular to the flow of fluid.

FIG. 5(*h*) illustrates a rectangular cross-section. This cross-section may be oriented with any of the four edges oriented opposite the direction of fluid flow. In some aspects, the rectangular cross-section can be oriented so that any one of the faces is oriented perpendicular to the flow of fluid.

FIG. 5(*i*) illustrates a rounded rectangular cross-section. This cross-section is similar to the rectangular cross-section of FIG. 5(*h*), but the corners of the rectangle have been rounded (e.g., chamfered or rounded). This cross-section may be oriented with any of the rounded corners oriented opposite the direction of fluid flow. In some aspects, the rounded rectangular cross-section can be oriented so that any one of the faces is oriented perpendicular to the flow of fluid.

FIG. 5 (*j*) illustrates a circular cross-section. This cross-section has no specific orientation. It will be appreciated that rods 120, 122 could have other cross-sections. In some aspects, rods 120 have a first cross-section, and rods 122 have a different cross-section. In some aspects rods 120, 122 have the same cross-section. In some aspects, the pluralities of rods 120, 122 may each comprise two or more cross-sections (e.g., a first set of rods 120/122 may have a first cross-section and a second set of rods 120/122 may have a second cross-section, etc.).

FIG. 5(*k*) illustrates a rounded diamond cross-section. This cross-section may be oriented with any of one of its edges oriented opposite the direction of fluid flow. In some aspects, the rounded diamond cross-section can be oriented so that any one of its faces is oriented perpendicular to the flow of fluid.

FIG. 5(*l*) illustrates a five-sided diamond cross-section. This cross-section may be oriented with any of its edges oriented opposite the direction of fluid flow. In some aspects, the five-sided diamond cross-section can be oriented so that any one of its faces is oriented perpendicular to the flow of fluid.

Figure 6:
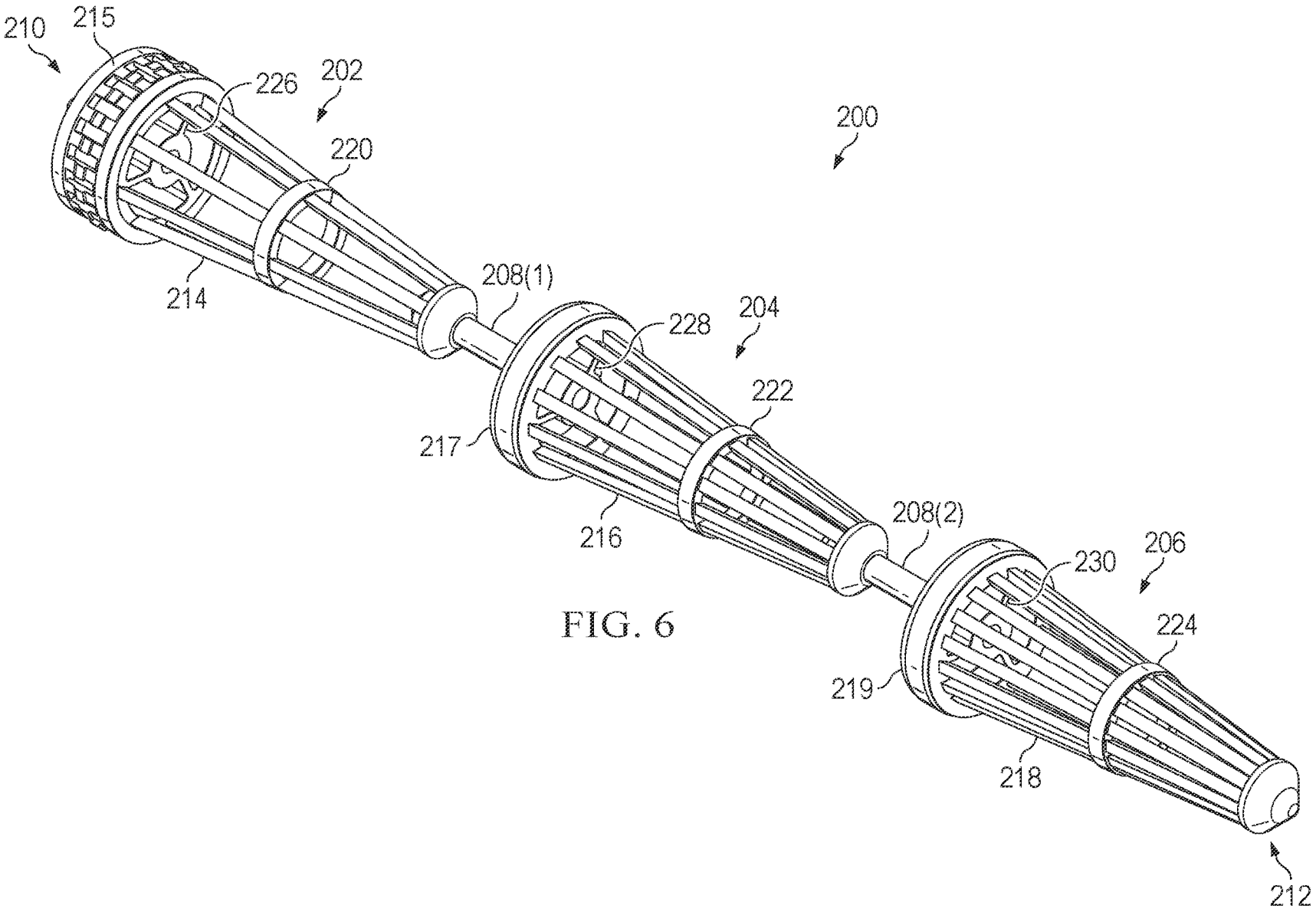
FIG. 6 illustrates a loss prevention screen according to aspects of the disclosure.

FIG. 6 illustrates a loss prevention tool 200 according to aspects of the disclosure. Tool 200 includes screens 202, 204, 206 that are joined together via an uphole link 208(1) and a downhole link 208(2). Tool 200 is configured to fit within housing 102, which has been hidden from view in FIG. 6 for purposes of clarity. Tool 200 has an uphole end 210 and a downhole end 212. In some aspects, tool 200 is configured to couple to stabilizers 110, 118.

Screen 202 includes a plurality of rods 214, with an uphole end of each rod 214 connected to a collar 215 and a downhole end of each rod 214 connected to a base of link 208(1). Collar 215 includes a bore through which fluid enters into screen 202. Collar 215 includes a stabilizer 226 comprising a plurality of fins (FIG. 6 illustrates three fins, though more or fewer fins can be used) that help break up aggregated LCM as the fluid flows through collar 215. The uphole end of each rod 214 is arranged to be radially farther from a central axis of tool 200 (closer to the inner wall of housing 102) than the downhole end of each rod 214. This arrangement is similar to the design of tool 100 discussed above and helps direct the flow of fluid from an inside of screen 202 to the outside of screen 202. In some aspects, a ring 220 is secured to rods 214 to provide rigidity and structure to rods 214. Fluid that exits screen 202 flows downhole and passes through a bore of a collar 217 of screen 204 to enter an interior of screen 204.

Screen 204 includes a plurality of rods 216, with an uphole end of each rod 216 connected to collar 217 and a downhole end of each rod 216 connected to a base of link 208(2). Collar 217 includes a stabilizer 228 comprising a plurality of fins (FIG. 6 illustrates three fins, though more or fewer fins can be used) that help break up aggregated LCM as the fluid flows through collar 217. The uphole end of each rod 216 is arranged to be radially farther from the central axis of tool 200 (closer to the inner wall of housing 102) than the downhole end of each rod 216. This arrangement is similar to the design of tool 100 discussed above and helps direct the flow of fluid from an inside of screen 204 to the outside of screen 204. In some aspects, a ring 222 is secured to rods 216 to provide rigidity and structure to rods 216. Fluid that exits screen 204 flows downhole and passes through a bore of a collar 219 of screen 206 to enter an interior of screen 206.

Screen 206 includes a plurality of rods 218, with an uphole end of each rod 218 connected to collar 219 and a downhole end of each rod 218 connected to downhole end 212. Collar 219 includes a stabilizer 230 comprising a plurality of fins (FIG. 6 illustrates three fins, though more or fewer fins can be used) that help break up aggregated LCM as the fluid flows through collar 219. The uphole end of each rod 218 is arranged to be radially farther from the central axis of tool 200 (closer to the inner wall of housing 102) than the downhole end of each rod 218. This arrangement is similar to the design of tool 100 discussed above and helps direct the flow of fluid from an inside of screen 206 to the outside of screen 206. In some aspects, a ring 224 is secured to rods 218 to provide rigidity and structure to rods 218. Fluid that exits screen 206 flows downhole and exits tool 200.

In some aspects, screen 204 has more rods than screen 202, and screen 206 has more rods than screen 204 so that the space between rods decreases with each successive filter. This helps gradually reduce the size of aggregated LCM pieces the fluid flows through each successive screen. In some aspects, the number of rods in screens 202, 204, 206 may be the same. In some aspects, lengths of rods 214, 216, 218 are the same. In some aspects, lengths of rods 214, 216, 218 may be different. Similar to tool 100, rods 214, 216, 218 may utilize any of the cross-sections discussed herein. In some aspects, the leading edges of rods 214, 216, 218 are oriented opposite the direction of fluid flow through screens 202, 204, 206 (i.e., radially inward).

Tool 200 is illustrated with three screens. In some aspects, tool 200 may have as few as one screen. In some aspects, tool 200 may have more than three screens. Tool 200 is designed so that the number of screens can easily be changed by simply using connecting rods 208 to connect the number of desired screens. It will be appreciated that tool 200 could be inverted within housing 102 so that fluid flowing through screens 202, 204, 206 could be reversed to flow from outside the screen to inside the screen. In these aspects, the orientation of the leading edges of the rods can be switched from radially inward to radially outward.

Figure 7:
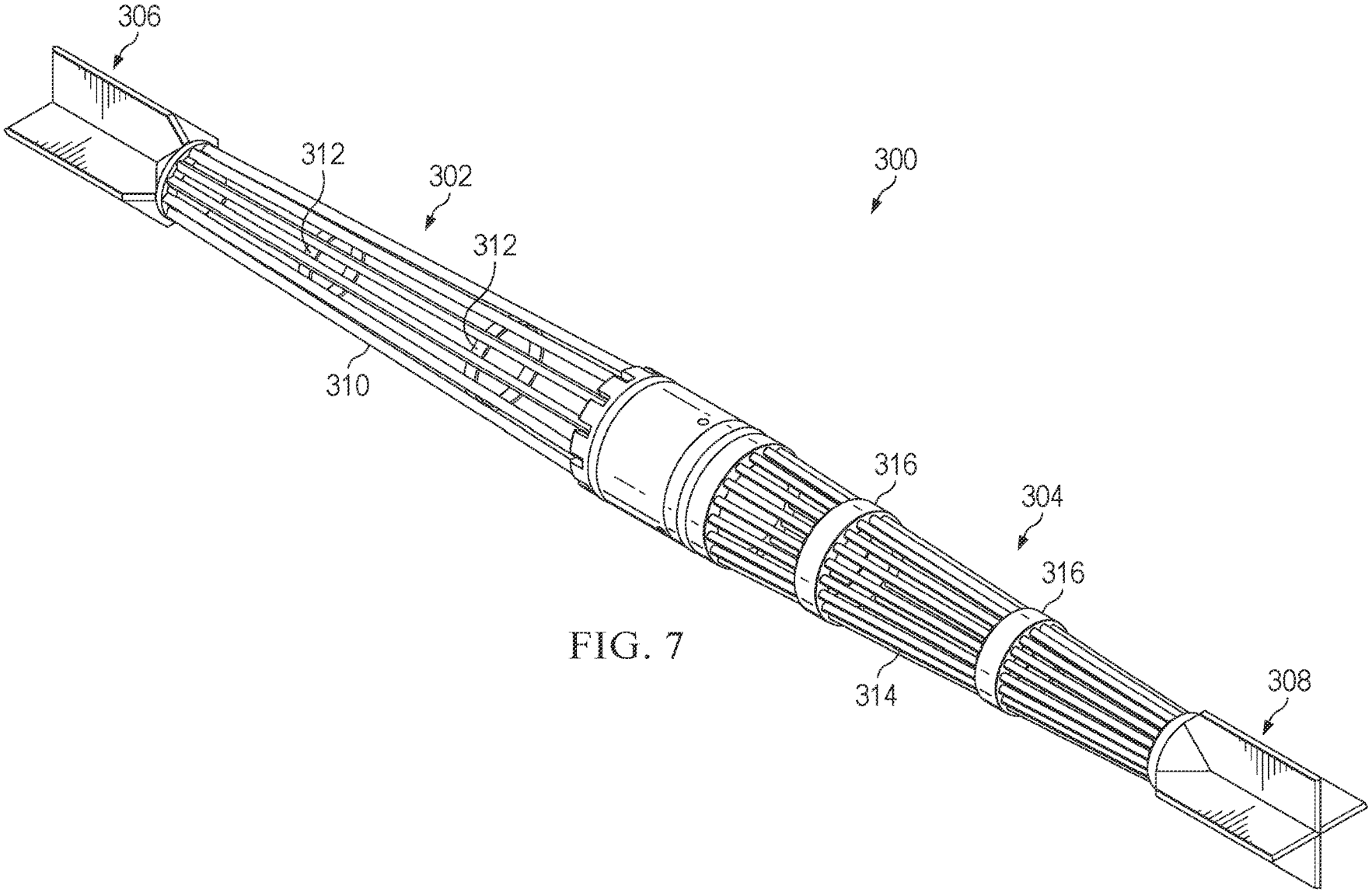
FIG. 7 illustrates a loss prevention screen according to aspects of the disclosure.

FIG. 7 illustrates a loss prevention tool 300 according to aspects of the disclosure. Tool 300 includes an upper screen 302 and a lower screen 304 that are joined together similar to the manner illustrated in FIGS. 1-4 (e.g., connection 114). Tool 300 is similar to tool 100 and is configured to fit within housing 102. Upper screen 302 includes a plurality of rods 310 that are supported radially by a pair of supports 312. Supports 312 are positioned on an inside of the plurality of rods 310, but could be positioned on the outside in other aspects. Each rod of the plurality of rods 310 is configured with a triangular cross-section, with a leading edge thereof facing radially outwards to face a direction of flow of fluid. Tool 300 includes a stabilizer 306 that is similar to stabilizer 110 that directs fluid flowing through tool 300 to flow radially into the plurality of rods 310.

Lower screen 304 includes a plurality of rods 314 that are supported by a pair of supports 316. Each rod of the plurality of rods 304 has a round cross-section. In other aspects, the plurality of rods 310, 314 could have any of the cross-sections illustrated in FIGS. 5(*a*)-5(*l*). Supports 316 include a plurality of holes through which each rod 314 passes. In various aspects, either of the designs of supports 312, 316 could be used to support the plurality of rods 310, 314 (or the rods from tools 100, 200). Lower screen 304 includes a stabilizer 308 that is similar to stabilizer 118.

Although various embodiments of the present disclosure have been illustrated in the accompanying Drawings and described in the foregoing Detailed Description, it will be understood that the present disclosure is not limited to the embodiments disclosed herein, but is capable of numerous rearrangements, modifications, and substitutions without departing from the spirit of the disclosure as set forth herein.

The term "substantially" is defined as largely but not necessarily wholly what is specified, as understood by a person of ordinary skill in the art. In any disclosed embodiment, the terms "substantially", "approximately", "generally", and "about" may be substituted with "within [a percentage] of" what is specified, where the percentage includes 0.1, 1, 5, and 10 percent.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions, and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a", "an", and other singular terms are intended to include the plural forms thereof unless specifically excluded.

Conditional language used herein, such as, among others, "can", "might", "may", "e.g.", and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

What is claimed is:

1. A loss prevention tool comprising:

a housing having a through bore; and a first loss prevention screen positioned within the housing and comprising:

a first stabilizer comprising a first plurality of fins; and a first plurality of rods, each rod of the first plurality of rods having an uphole end and a downhole end, the uphole end of each rod of the first plurality of rods being connected to the first stabilizer, wherein the first plurality of rods is arranged so that fluid flowing through the housing passes through gaps between adjacent rods of the first plurality of rods; and a second loss prevention screen positioned within the housing and comprising:

a second stabilizer comprising a second plurality of fins; and a second plurality of rods, each rod of the second plurality of rods having an uphole end and a downhole end, one of the uphole end or the downhole end of each rod of the second plurality of rods being connected to the second stabilizer, wherein the second plurality of rods is arranged so that fluid flowing through the housing passes through gaps between adjacent rods of the second plurality of rods, wherein the first plurality of rods contains fewer rods than the second plurality of rods.

2. The loss prevention tool of claim 1, wherein the first loss prevention screen is coupled to the second loss prevention screen via a stub connection.

3. The loss prevention tool of claim 2, wherein each upper end of the first plurality of rods is radially closer to a central axis of the loss prevention tool than each lower end of the first plurality of rods.

4. The loss prevention tool of claim 3, wherein each upper end of the second plurality of rods is radially farther from the central axis of the loss prevention tool than each lower end of the second plurality of rods.

5. The loss prevention tool of claim 1, wherein a rod of the first plurality of rods has a leading edge that is oriented radially outward.

6. The loss prevention tool of claim 1, wherein a rod of the first plurality of rods has a leading edge that is oriented radially inward.

7. The loss prevention tool of claim 1, wherein the first stabilizer directs a flow of fluid to an outside of the first loss prevention screen before the fluid flows between the first plurality of rods.

* * * * *